2-150 SR
10/15/85 XR 4,546,494

United States Patent [19]

Garber

[11] Patent Number: 4,546,494

[45] Date of Patent: Oct. 15, 1985

[54] NECKTIE CONSTRUCTION

[76] Inventor: Michael I. Garber, 282 Davis St., Greenfield, Mass. 01301

[21] Appl. No.: 663,764

[22] Filed: Oct. 22, 1984

[51] Int. Cl.[4] ..... A41D 25/00; A41D 25/02

[52] U.S. Cl. ..... 2/144; 2/150

[58] Field of Search ..... 2/145, 149, 150, 151, 2/339, 338, 144; 223/81, 82

[56] References Cited

U.S. PATENT DOCUMENTS

| | | | |
|---|---|---|---|
| 622,331 | 4/1899 | Disbrow | 2/149 |
| 1,775,431 | 9/1930 | Hofmann | 223/82 |
| 2,081,653 | 5/1937 | Whiting | 2/150 |
| 2,642,572 | 6/1953 | Tobias | 2/150 |
| 2,648,846 | 8/1953 | Titone | 2/150 |
| 2,766,459 | 10/1956 | Stiglin | 2/339 |
| 2,874,386 | 2/1959 | Loomis | 2/150 |
| 3,030,631 | 4/1962 | Tobias | 2/150 |

FOREIGN PATENT DOCUMENTS

| | | | |
|---|---|---|---|
| 631153 | 11/1961 | Canada | 2/144 |

*Primary Examiner*—Louis K. Rimrodt
*Assistant Examiner*—Joseph S. Machuga

[57] ABSTRACT

Necktie structure made of a plurality of articulated wood panels. One of the panels is shaped to simulate a four-in-hand knot portion of the necktie and a second panel is shaped to simulate the body portion of the tie. A third triangular panel is disposed in edge-to-edge relation with the lower end of the second panel. The panels are hinged together at their adjacent edges to form an articulated, coplanar structure. A flexible neckband for encircling the neck of the wearer is affixed to the undersurface of the knot-forming panel.

6 Claims, 4 Drawing Figures

4546494

NECKTIE CONSTRUCTION

BACKGROUND OF THE INVENTION

For centuries, people have been accustomed to wearing various items of personal neck adornment, such as necklaces, beads, furs, scarfs, bandannas, and neckties. Men's neckties have invariably been made of decorated textile fabrics which are shaped for manual tying into the form of a bow or a four-in-hand knot. In more recent times, the majority of men prefer four-in-hand type neckties which are not pre-tied, although lately pre-tied products of this general type have found a corner in the neckwear marketplace.

Although personal neck adornment in the form of necklaces have commonly employed all types of materials, including precious and semi-precious metals, gem stones and other combinations of highly decorative and durable materials, these rigid materials have not been used to fabricate the structure of the necktie itself. Occasionally, these materials, in the form of stick pins and tie clasps, have been used as surface decorations on fabric neckties worn by men. Wood, although a beautiful, natural and durable material which is available in an infinite variety of species, grains and finishes, has not been used in the fabrication of men's neckwear. The apparent reason for this mind set is that wood, although resilient, is quite rigid and thought to be "too boardy" for this type of apparel application.

The principal object of this invention is to provide, as an article of practicable wearing apparel, a necktie constructed of wood.

Another object of this invention is to provide a necktie structure which renders feasible the application of wood or other rigid or semi-rigid materials for this purpose.

The above and other objects and advantages of this invention will be more readily apparent from the following description read in conjunction with their accompanying drawing in which.

DETAILED DESCRIPTION

Figure 1:
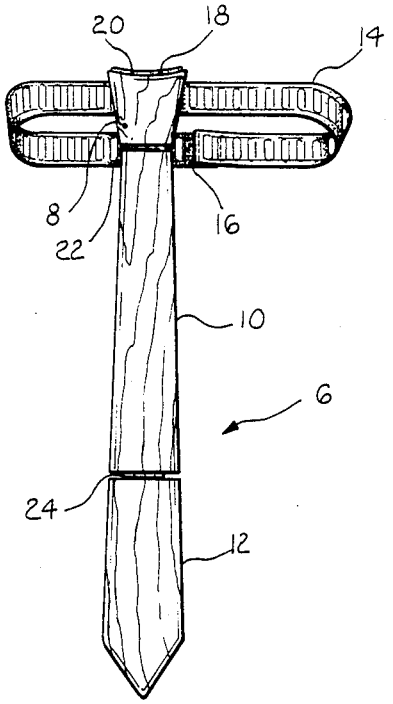
FIG. 1 is a front elevational view of a necktie structure of the type embodying this invention.

Referring now in detail to the drawing, a necktie shown generally at 6 is an example of a structure of the type embodying my invention. The necktie 6 comprises a plurality of individual panels 8, 10 and 12 which are hingedly interconnected in coplanar relation to form an articulated structure. The upper panel 8 is of generally truncated triangular configuration of approximately the same shape and size as the planar projection of the four-in-hand knot portion of a necktie so as to closely simulate the same. The side edges of the panel 8 are tapered downwardly and inwardly and terminate in a lower, transverse edge. The upper or wider edge 18 of the panel 8 is preferably of generally arcuate, concave configuration to conform approximately with the contour of the wearer's neck. A strip of elastomeric foam or cushion material 20 is preferably bonded to this upper edge for added wearer comfort. The lower straight edge of the knot panel 8 is pivotably interconnected in end-to-end relation with the transverse, straight upper edge of an intermediate or body panel 10.

Figure 2:
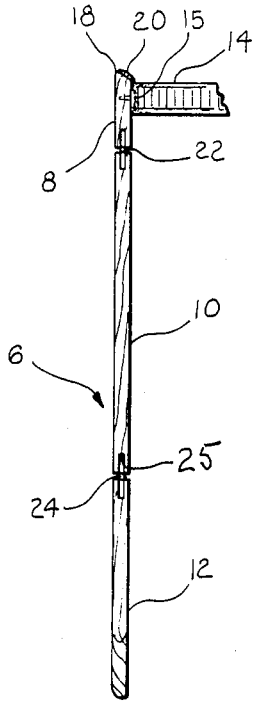
FIG. 2 is a side elevational view of the necktie of FIG. 1.

The two panels are connected together by means of a small hinge element 22, as shown in FIGS. 1 and 2. The hinge is a two-way type so that the two panels may be swung in opposite directions relative to one another, thus providing a high degree of flexibility between these two sections. The intermediate or body portion of the necktie is represented by the panel 10 which, as shown, includes downwardly and outwardly tapered side edges and with transverse end edges generally perpendicular to the longitudinal axis of the panel. Of course, if preferred, the side edges of the panel 10 may be made parallel to give a more rectangular knit-tie look.

The lower panel of the necktie structure, shown at 12 in the drawing, is hingedly interconnected with the lower edge of the intermediate panel 10 by means of a hinge element 24 which may be identical to the hinge element 22. The lower edge of the panel 12, as shown, includes a generally pointed or triangular portion, as is common with fabric neckties of the woven variety. If preferred, however, the lower panel may have a generally rectangular configuration, again to simulate the knit-tie look.

Adjacent its upper edge and on the back or under surface of the knot panel 8, is an open ended flexible, elastic band 14. As shown generally at 16, Velcro fastening elements are provided at the opposite ends of the band so that the band may be "opened" and "closed" to form a closed loop about the neck of the wearer.

The panels which make up the necktie structure 6, may be about $\frac{1}{8}''$ to $\frac{3}{8}''$ inch in thickness and may be shaped and finished by conventional woodworking techniques and various types of wood such as walnut, oak, cherry, cedar and the like may be selected for different decorative effects. All the edges and surfaces are sanded and smoothly finished. The wood may also be stained, varnished or left in its natural state to achieve various decorative effects, much in the same manner as the finishing of any beautiful article of wood furniture.

The hinges 22 and 24 may be made of any suitable material such as metal or plastic and, as shown in FIG. 2, the plate portions of the hinges are preferably fitted into oppositely opening slots 25 formed in the adjacent edges of the three panels. Alternatively, a flexible joint material such as canvas, plastic or rubber strips may be used and either secured within the opposed slots or fastened by any suitable fastener means or bonding agents to the back portions to the panels adjacent their hinged edges.

While an article of manufacture of this type may have appeal as a novelty item, it is also important that the necktie structure and the wood employed therein be selected and finished in such a manner as to provide an attractive wood necktie as an acceptable and practicable alternative to a textile necktie as an article of wearing apparel.

Figure 3:
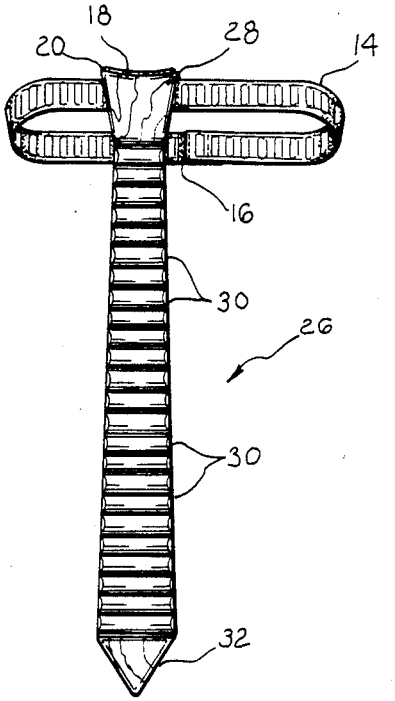
FIG. 3 is an alternate embodiment of a necktie structure of the type embodying this invention.
Figure 4:
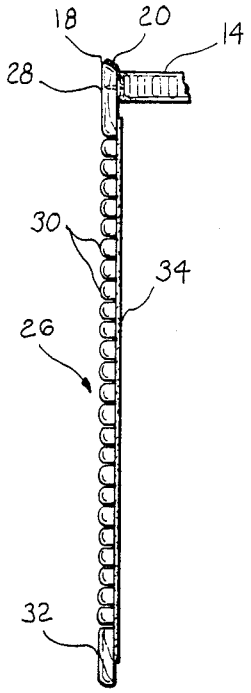
FIG. 4 is a side elevational view of the necktie shown in FIG. 3.

At 26, in FIGS. 3 and 4, is shown an alternate necktie construction of the type embodying this invention. The necktie 26 comprises an upper panel 28 of generally the same construction, as shown at 8 in FIG. 1. Also, flexible neckband 14 is provided which may be identical to the neckband shown with respect to FIG. 1. From the lower edge of the knot forming panel 28, the body portion of the necktie 26 is a tambour construction and includes a plurality of small segments of generally semicircular cross-section disposed in parallel, transverse edge-to-edge relation. The segments are affixed to a strip of a flexible backing material 34 (FIG. 4), such as canvas or any other suitably resilient and durable synthetic plastic material. The lower end of the necktie may be of generally configuration, as shown at 32 or, if preferred, this lower panel may be omitted so that the lower edge of tie has a straight or squared off look, as commonly used in the knitted tie.

Having thus described my invention, what is claimed is:

1. Necktie construction comprising a plurality of relatively rigid pre-shaped panels hingedly interconnected in end-to-end, coplanar relation, one of said panels being generally in the shape of a four-in-hand knot and at least one other panel being hingedly connected in contiguous relation to the lower end of the one panel and a flexible neckband attached to said one panel.

2. Necktie construction as set forth in claim 1, in which the plurality of panels includes an upper wood panel generally in the shape of a four-in-hand knot and spaced, parallel, wood segments hingedly interconnected to the lower edge of the knot shaped panel, said segments being hingedly connected in end-to-end relation in a tambour construction.

3. Necktie construction as set forth in claim 1, in which the knot shaped panel is of truncated, triangular configuration with inwardly tapered side edges, its narrower end being hingedly connected to said other panel, said panels being wood.

4. Necktie construction as set forth in claim 3, in which the other panel includes side edges tapered outwardly and downwardly from its upper end which is hingedly connected to the lower end of said one panel.

5. Necktie construction as set forth in claim 4, in which said plurality of panels comprises at least three wood panels, including an upper knot simulating panel, an intermediate body panel and a triangular lower end panel, each of said panels being hingedly interconnected in end-to-end, coplanar relation with the adjacent panel to form an articulated four-in-hand wooden necktie construction.

6. Necktie construction as set forth in claim 5, in which said one panel of knot configuration includes a concave upper edge portion with a cushion material disposed along the curved edge thereof.

* * * * *